United States Patent [19]

Eaton

[11] 4,015,392

[45] Apr. 5, 1977

[54] BUILDING WALL PANEL SYSTEM

[75] Inventor: James W. Eaton, Sleepy Hollow, Ill.

[73] Assignee: Masonite Corporation, Chicago, Ill.

[22] Filed: Jan. 26, 1976

[21] Appl. No.: 652,413

[52] U.S. Cl. ..... 52/533; 52/540; 52/541; 52/551; 52/554

[51] Int. Cl.[2] ..... E04D 1/00

[58] Field of Search ..... 52/533, 540, 314, 555, 52/527, 535, 542, 313, 553, 548, 536, 554, 519, 541, 551

[56] References Cited

UNITED STATES PATENTS

| | | | |
|---|---|---|---|
| 2,659,323 | 11/1953 | Alvarez, Jr. | 52/533 X |
| 3,333,384 | 8/1967 | Brady | 52/540 X |
| 3,796,586 | 3/1974 | Hanlon et al. | 52/313 X |
| 3,852,933 | 12/1974 | Guzzo | 52/548 X |
| 3,897,667 | 8/1975 | Turek | 52/314 X |

*Primary Examiner*—Price C. Faw, Jr.
*Assistant Examiner*—Carl D. Friedman
*Attorney, Agent, or Firm*—Mason, Kolehmainen, Rathburn & Wyss

[57] ABSTRACT

An integral siding/roofing building wall panel system comprising panels having an elongated rectangular base of structural sheet material having opposite inner and outer faces and longitudinal upper and lower edges dimensioned to span across at least one pair of spaced apart upwardly extending parallel structural supports of a building frame such as studs, rafters and the like, opposite ends of the base are adapted to lie along the structural supports, and an outer weather member of sheet material is integrally attached to the outer face of the base, said outer member having a decorative outer weather resistant surface embossed to resemble a plurality of shingle elements laid side by side and having an upper edge spaced downwardly and parallel of the upper edge of the base and sloping upwardly of the outwardly facing surface of the base at an acute angle for interlocking engagement with the lower edge of the base of a building wall panel in an adjacent upper level or row, said outer weather member including a lower edge portion projecting downwardly below the lower edge of the base and adapted to overlie an upper edge portion of the base of a building wall panel in an adjacent lower row, said lower edge portion having an irregular lower edge embossed to resemble the lower edges of a row of shingles placed side by side.

8 Claims, 14 Drawing Figures

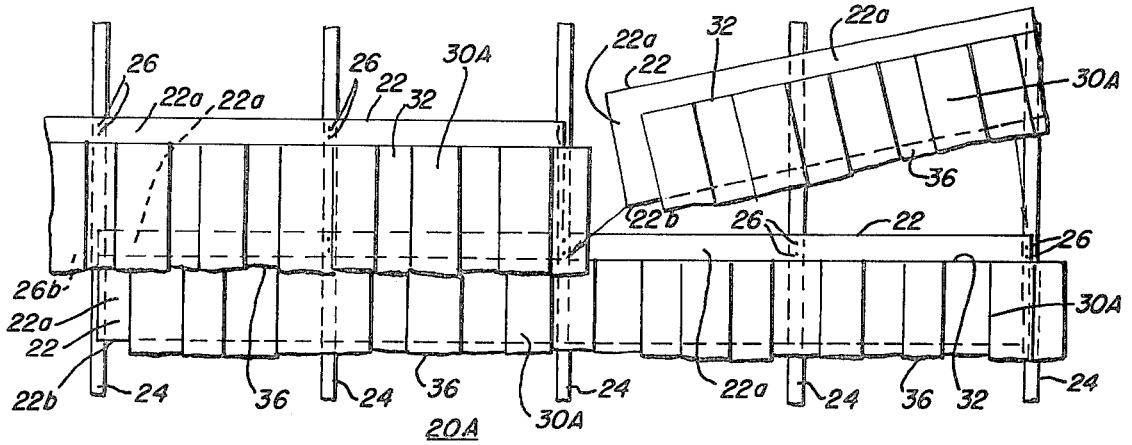
FIG. 5
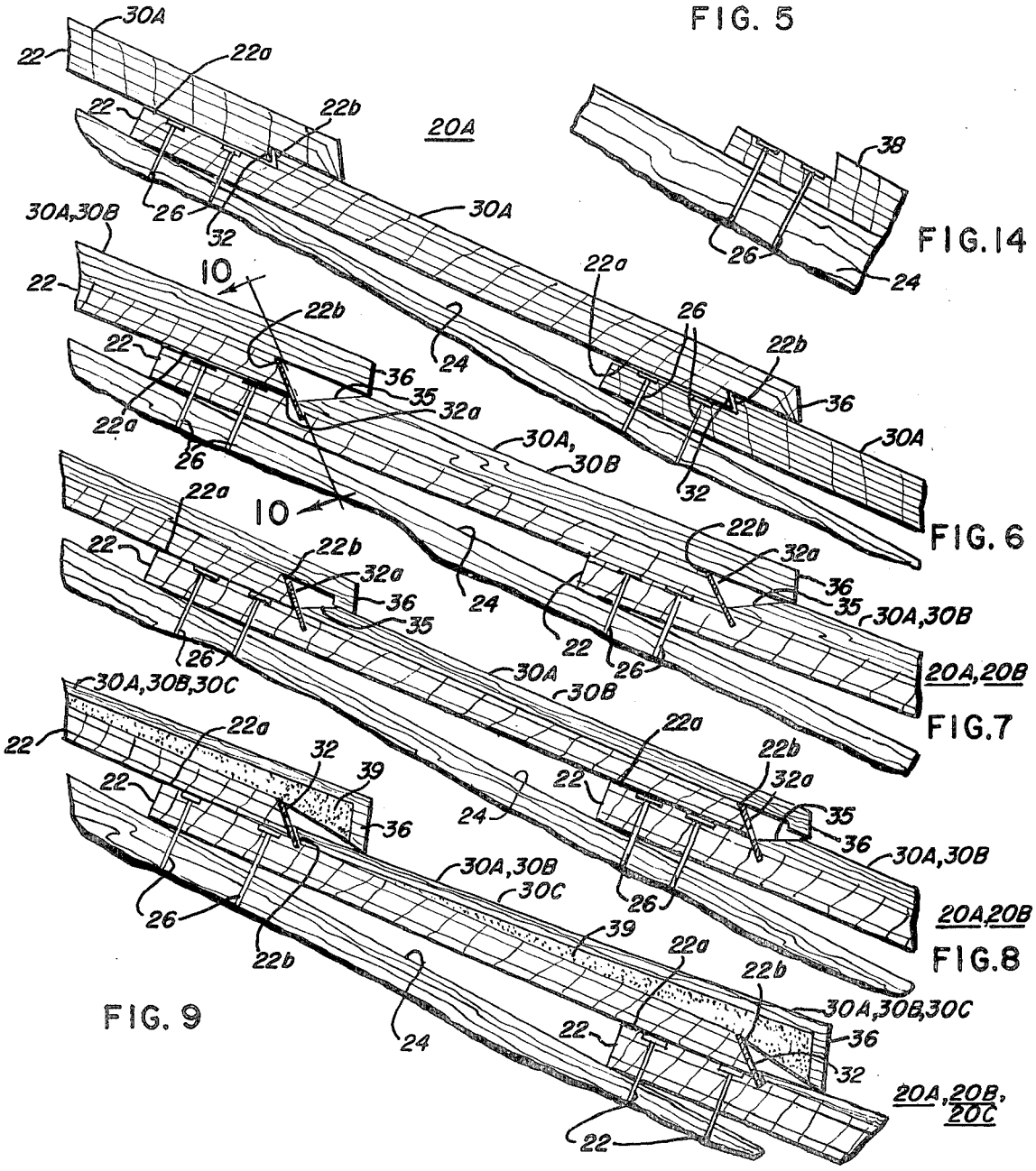

BUILDING WALL PANEL SYSTEM

BACKGROUND OF THE INVENTION

1. Field of the Invention

The present invention relates to building wall panels and more particularly to building wall panels for use in structural siding and roofing applications.

It is an object of the present invention to provide a new and improved building wall panel and more particularly a building wall panel suitable for use as a one-piece structural siding or roofing member with a weather resistant outer face.

Another object of the present invention is to provide an integral siding/roofing building wall panel of the character described which provides both structural integrity and exterior weather facing for direct application to studs or rafters of a building structure without requiring further materials.

It is another object of the present invention to provide a new and improved building wall panel of the character described having suitable structural characteristics and a one-piece embossed outer weather surface resembling shingles laid in place.

Another object of the invention is to provide a new and improved building wall panel of the character described wherein the outer surface of the panel is formed in relief to resemble wood shingles, slate roofing, tile roofing or the like.

Another object of the present invention is to provide a new and improved building wall panel of the character described which is light in weight, strong, weatherproof, easy to handle and rapidly installable on the framework of a building.

Another object of the present invention is to provide a new and improved building wall panel of the character described having a novel system for interlocking application of adjacent rows of wall panels to provide a weatherproof wall structure.

Another object of the present invention is to provide a new and improved building wall panel of the character described having a novel system for effecting end to end interlocking weatherproof joints between panels in the same row.

Another object of the present invention is to provide a new and improved building wall panel of the character described employing a novel system for structurally interlocking the edges and ends of the panels together to form a structurally aesthetic and weather tight wall or roof surface.

Another object of the present invention is to provide a new and improved building wall panel of the character described wherein the outer weather facing member of the panel is formed of embossed material to resemble a plurality of separate shingles, shakes, slate or tile, laid in place side by side. Another object of the present invention is to provide a new and improved building wall panel of the character described having a novel water drainage system for draining and removing water or moisture which may penetrate beneath the level of the outer facing member of the panels.

2. Description of the Prior Art

Typical of the prior art is U.S. Pat. No. Re. 27,502 directed towards a single shingle system including a plywood backer member with a tarred felt membrane on the outer surface of the backer and a layer comprising a plurality of shingles individually attached to the backer with another outer layer of individual shakes assembled onto the first layer of shingles.

Another patent of interest is U.S. Pat. No. 3,546,843 directed towards a combination roofing/sheathing panel system employing a plywood substrate with a waterproof overlay and a single row of low-grade individual short shakes or shingles stitched to the substrate.

SUMMARY OF THE INVENTION

Briefly, the foregoing and other objects and advantages of the present invention are accomplished in a new and improved integral siding/roofing building wall panel comprising an elongated rectangular base of structural sheet material having opposite inner and outer faces and longitudinal upper and lower edges dimensioned to extend across at least one pair of spaced apart upwardly extending building support members such as rafters, joints or studs. The base includes opposite ends adapted to lie adjacent the supports and an outer weather member integrally formed of embossed sheet material and positively secured to the outer surface of the base. The outer weather member includes an outer weather resistant decorative outer surface formed by embossing to resemble a plurality of shingle elements laid side by side, and has an upper edge spaced downwardly of and parallel of the upper edge of the base. This upper edge slopes upwardly of the outer surface of the base at an acute angle and is adapted for positive interlocking engagement with a matching lower edge of the base of the wall panel in an adjacent upper level or row. The outer member includes a lower edge portion extending downwardly below the lower edge of its underlying base which is adapted to overlie a marginal upper edge portion on the base of a building wall panel in an adjacent lower level or row. The lower edge portion of the outer weather member is formed with an irregular lower edge to resemble the lower edges of shingle elements placed side by side and the member is integrally formed of a single piece of sheet material in an embossing process. The sheet material may comprise embossed hard board, plywood, plastic or embossed molded polyurethane foam and the like formed in place on the structural base which normally is formed of plywood or other suitable substrate. The building panels of the invention may be up to eight feet in length and of varying dimension transverse thereto depending upon whether the panel is designed to resemble shakes, wood shingles, roofing slate or tile. The building panels may also be formed in shorter lengths in multiples of the standard sixteen inch on center as used in building frames. A unique system is provided for interlocking panels in adjacent rows together to provide a structurally strong and weather tight joint between the rows of panels in a manner suitable for use on both vertical walls or sloping roofs.

BRIEF DESCRIPTION OF THE DRAWINGS

For a better understanding of the present invention, reference should be had to the following detailed description taken in conjunction with the drawings in which:

FIG. 5 is a fragmentary elevational view of a building structure showing in animated form, individual building wall panels of the present invention as they are assembled onto upstanding structural supports;

FIG. 6 is a vertical sectional view taken transversely across another embodiment of a building wall panel in accordance with the present invention and showing in detail, the interlocking of a pair of panels together and attachment of the panels to the supporting structure;

FIG. 7 is a vertical sectional view similar to FIG. 6 showing yet another embodiment of building panels in accordance with the invention;

FIG. 8 is a vertical sectional view similar to FIG. 6 illustrating yet another embodiment of building wall panels in accordance with the present invention;

FIG. 9 is a vertical sectional view similar to FIG. 6 illustrating yet another embodiment of building panels constructed in accordance with the features of the present invention;

FIG. 14 is a transverse cross-sectional view taken through a starter strip in accordance with the present invention.

DESCRIPTION OF THE PREFERRED EMBODIMENT

Figure 1:
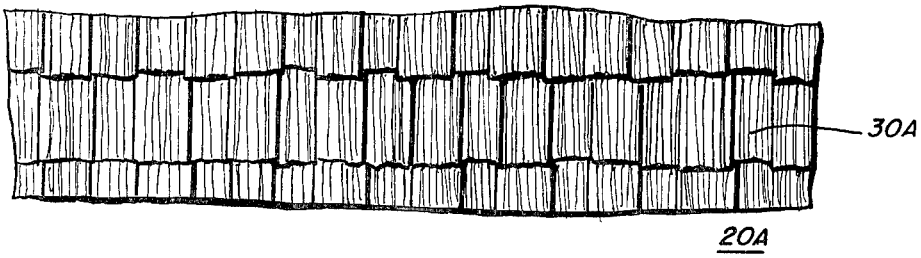
FIG. 1 is an outside view of a building wall surface formed with a plurality of building wall panels constructed in accordnace with the features of the present invention and designed to resemble wood shakes.
Figure 2:
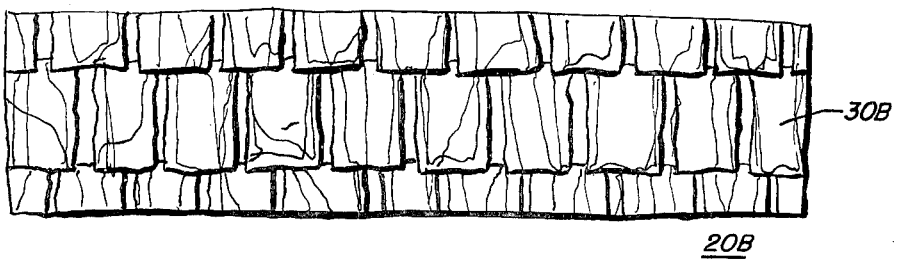
FIG. 2 is a view similar to FIG. 1, but illustrating another embodiment of building wall panels in accordance with the invention designed to resemble slate roofing tiles.
Figure 3:
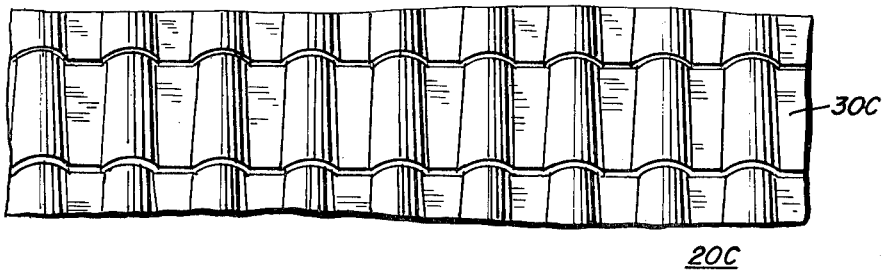
FIG. 3 is a view similar to FIG. 1 and illustrating yet another embodiment of building wall panels in accordance with the present invention designed to resemble curved roofing tiles.

Referring now to FIGS. 1, 2 and 3, therein is illustrated a plurality of building wall panels 20A, 20B and 20C constructed in accordance with the present invention and designed to resemble a building wall or roof surface having wood shingles or shakes, natural slate roofing tiles, and Spanish type roofing tiles, respectively. As best shown in FIGS. 4–10, each of the building wall panels includes a rectangular structural base or backing member 22 of elongated shape and dimensioned longitudinally to span at least one pair (preferably several pairs) of upright structural support members 24 such as studs, rafters or joints of a building. These members are normally spaced 16 inches on center, and the building panels may be up to 8 feet in length. The structural backing memers or bases of the panels are preferably formed of strong, durable sheet material such as exterior plywood sheathing and are dimensioned in lengths that are multiples of the spacing distance between adjacent pairs of supports 24 to which the building wall panels are to be attached. The panels are secured in place by means of nails 26 or other suitable fasteners driven through an exposed narrow upper marginal edge portion 22*a* of the backing member 22.

Each of the wall panels 20A, 20B and 20C also include an integral weather resistant outer face member 30A, 30B and 30C respectively formed of weather resistant sheet material integral with or secured by laminating to its underlying rectangular base 22. The outer surface of the outer face members are formed by an embossing or molding process dependent upon the particular material used and are provided with deep relief to closely resemble a roofing or wall surface made up of wood shingles or shakes in the case of the panels 20A, natural slate roofing or wall tiles in the case of the panels 20B or Spanish style roofing tiles in the case of the panels 20C.

As best shown in FIGS. 5–9 the building wall panels includes a unique arrangement for mechanically interlocking successive rows of panels assembled in place on their supporting structural members 24. For this purpose, the outer face or weather members 30A, 30B and 30C have an upper edge 32 spaced below the upper edge of the backing or structural base 22 exposing a flat outer surface of the base along a narrow marginal upper edge portion 22*a* of the panel. As shown in FIGS. 6 and 9 the upper edge 32 of the outer face members 30A, 30B and 30C, respectively, slope upwardly relative to the outer surface of the base 22 at an acute angle.

The rectangular base 22 of the panels have lower edges 22*b* parallel with the edges 32 and slope at similar acute angles to provide for positive interlocking between adjacent rows of the building panels when assembled in a wall or roof structure. In addition to the mechanical interlocking arrangement between the panels in adjacent rows of a building structure, the panels also may be interlocked adjacent opposite ends in a sort of ship lap arrangement if desired and for this purpose the outer weather face members 30A, 30B and 30C extend outwardly beyond the right hand ends of the base 22 as shown in FIG. 5 to overlie an end portion of the base next adjacent in the same row of panels. The left hand ends of the bases 22 extend leftward of the face members 30A, 30B and 30C respectively, leaving marginal left hand ends 22C of the bases uncovered.

Figure 4:
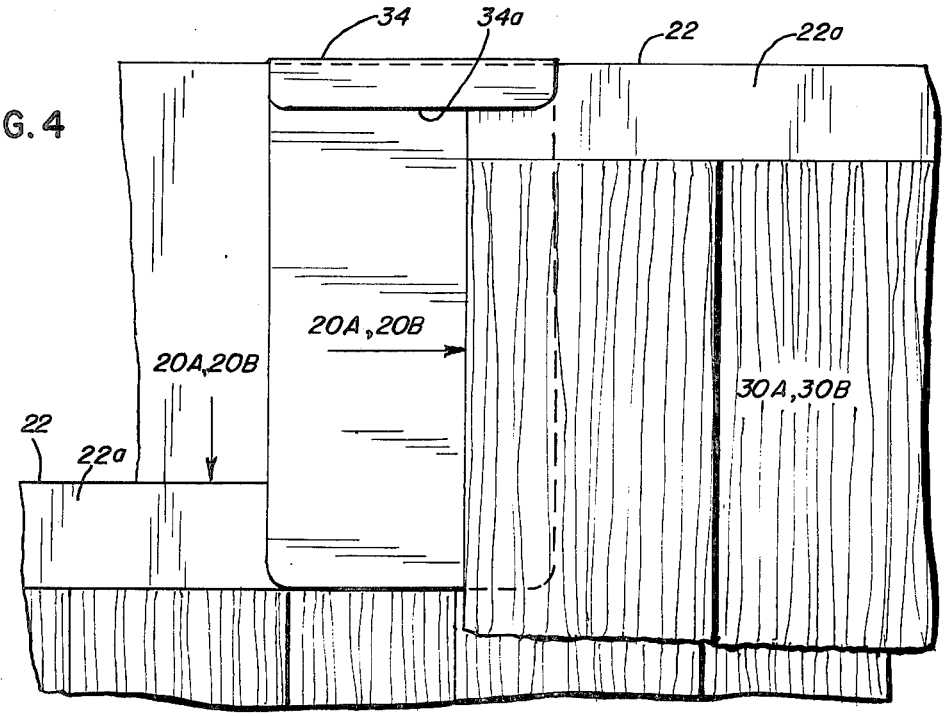
FIG. 4 is an enlarged detail showing one system for interconnecting the ends of the building panels in accordance with the features of the present invention.

Referring briefly to FIG. 4, in accordance with the invention, the panel systems 30A and 30B may also be fabricated for striaght end joints and when this is done, a metal flashing member 34 is provided having a lip 34A along the upper end. The lip secures the flashing member to the upper edge of the base 22 of each panel and includes a body underlying the joint between butting adjacent ends of a pair of building panels 20A or 20B in the same row. In the event it is necessary to butt joint a pair of panels at a point intermediate the supports 24, flashing members 34 are used so that any water leakage at the joint between the abutting ends will be channeled by the flashing onto the outer surfaces of the weather face members 30A and 30B in the next lower row of building panels.

In accordance with the present invention a variety of different materials may be utilized in producing the novel building wall panels 20A, 20B and 20C. Referring to FIG. 6, panels 20A having an outer weather member of resembling wood shakes and shingles 30A are formed of the outer layers of multi-layer exterior plywood having a suitable number of layers for the desired strength and having an outer weather resistant surface formed in an embossing process with an irregular lower edge 36 formed by compression and bending under pressure and heat. This results in an irregular line accurately resembling the lower or butt ends of wood shingles or shakes and the like and does not leave end grain exposed. The interlocking edge surfaces 32 and 22*b* as well as the marginal upper edge face 22*a* and marginal end face 22*c* are formed with wood working groove cutting machinery from a single sheet of plywood. The outer or weather surface of the outer face member 30A is then formed by an embossing process followed by impregnation with stain, paint, "Wolmanizing" or other treatment of the wood to make it more resistant to weathering. As shown in FIG. 6, the pinched over plies along the lower edge 36 are developed in the embossing process by heat and pressure and reduce the exposure of end grain to further reduce moisture pick-up. In installing the panels 20A the first or lowest row of panels is attached and interlocked to a pre-position, a starter strip 38 having a cross-section as shown in FIG. 14 which is similar to the upper segment of the panel members. The starter strip is readily attached to the upright supports 24 with nails 26 in a manner similar to the manner of attachment of the building wall panels.

Referring to FIG. 7, both building wall panels 30A and 30B may be constructed with a base or backer 22 formed of suitable strength exterior plywood with outer face covered below the marginal edge 22*a* and inward of the marginal end 22*c* by an outer weather resistant member 30A or 30B formed of suitably finished, embossed hardboard. For example, hardboard such as "Masonite" about 7/16 inch thick is embossed to provide the appearances of wood shakes or natural slate roofing tiles 30A or 30B as shown. As in the panel 20A of FIG. 6, the lower end portion of the outer weather resistant face members 30A and 30B extend downwardly beyond the lower edge 22*b* of the base 22 to overlie the upper marginal edge surface 22*a* of the panels in the next lower row. The outer weather resistant face members 30A and 30B of the panels of FIG. 7, may also be made from molded or foamed in place polyurethane foam having a thick weather resistent outer skin and suitably adhered to the outer surface of the plywood base 22.

Figure 10:
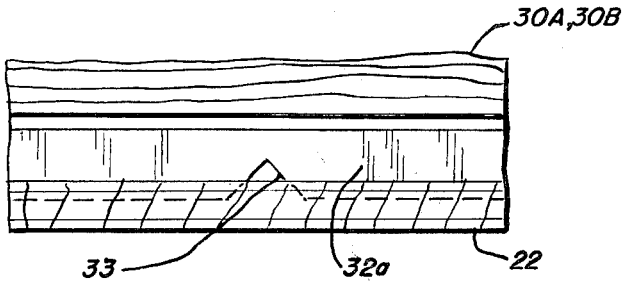
FIG. 10 is an enlarged fragmentary sectional view taken along lines 10—10 of FIG. 7 illustrating a portion of the water drainage system in accordance with the present invention.
Figure 11:
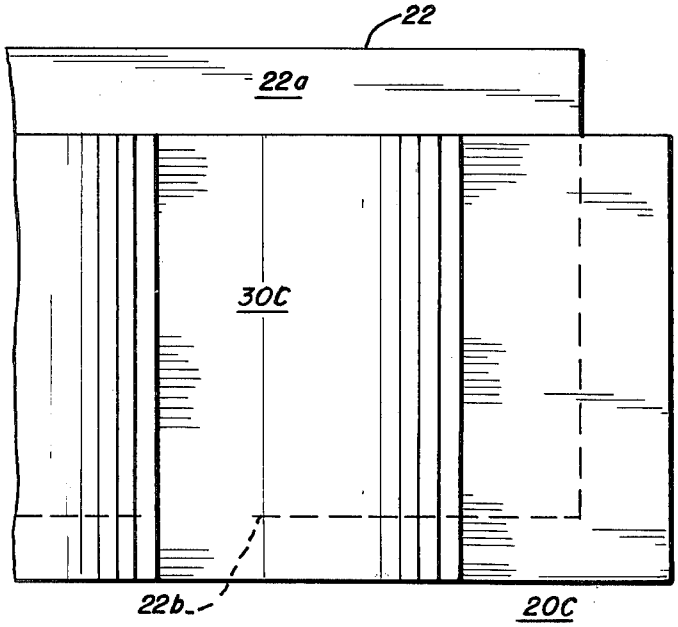
FIG. 11 is a fragmentary elevational view of an end portion of yet another embodiment of a building wall panel constructed in accordance with the present invention.
Figure 12:
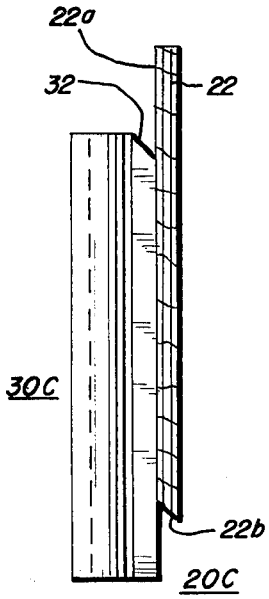
FIG. 12 is an end elevational view of the building panel of FIG. 11.

In accordance with the invention, the building panels 20A and 20B of FIG. 7 are provided with a unique vented spline interlocking key 32*a* which has a lower portion extending into a groove cut at an acute angle in the base 22. The splines 32*a* project upwardly from the outer face of the member 22 at an acute angle equal to the angle of the lower edge surface 22*b*. As shown in FIG. 10, the thin splines are formed of fiber or metal strips and are provided with V-shaped grooves 33 at spaced locations so that any moisture collecting in the area between the projecting lower edge portions of the overlying weather members 30A or 30B of the panels may flow along the splines until reaching a V-groove and eventually pass through the groove onto the outer face of the next lower row of building panels. Upper edge portions of the outer weather face members 30A and 30B of the building panels 20A and 20B of FIG. 7 are provided with beveled edge segments 35 to form an open area of triangular cross-section. These open areas permit equalization of air pressure and discourage moisture from passing upwardly between the interlocking edges when driving winds and rains occur.

Referring to FIG. 8, the building wall panels 20A and 20B therein shown, have outer weather or face members 30A or 30B formed of post press embossed hardboard of approximately ⅛ – ¼ inch thick and the lower edge 36 of this hardboard is also pinched over downwardly to better seal against moisture absorption against the upper surface of the panels in the next lower row. Water that collects in the triangular shaped cross-section open area formed beneath the projecting lower edge segments of the outer weather face members 30A and 30B may flow along the open area until reaching a groove between adjacent shingles or slates in the pattern formed in the embossing process in the hardboard.

Figure 13:
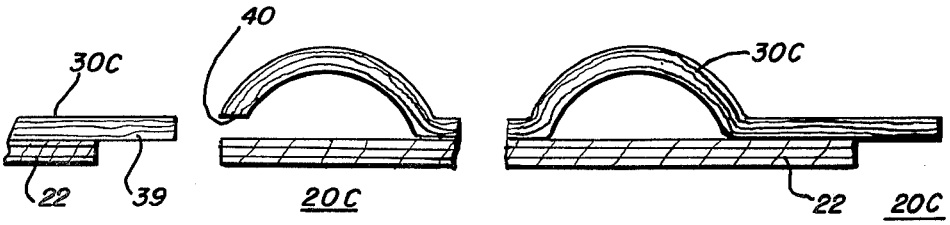
FIG. 13 is an edge elevational view of the building wall panels of FIG. 3 and illustrating in detail the end to end joint between the panels.

Referring now to FIGS. 9 and 11–13, the building panels 20A, 20B and 20C may be formed with a plywood backer or base 22 of rectangular shape and an outer weather face member 30A, 30B or 30C of die-formed hardboard pinched over at the lower edge 36 in the case of the panels 30A and 30B and backed up with a layer of insulating and thickening polyurethane foam laminated between the outer surface of the base 22 and the inner surface of the weather face members. In the case of the Spanish type panel 30C, the foam layer may be eliminated in the lower edge segments within the arched or raised portions, as best shown in FIG. 13. The lower ends of the arched segments will not be pinched over as at 36 in FIG. 9, but will overlie or lap the segments in the adjacent lower row.

The outer weather face members 30A, 30B and 30C may also be constructed of vacuum formed polyurethane foam having an integral tough and thick outer skin thereon providing good weather resistance.

Referring to FIG. 13, a modified butt end joint arrangement is provided for the building panels 20C wherein a flat marginal edge portion 39 of the outer weather face member 30C is adapted to insert endwise into a slot or opening 40 on the adjacent end of a panel 20C between the edge of a raised or archer tile segment and the base 22. This tongue and groove arrangement provides good end to end sealing and any water accumulating in the area between the raised or arched segments of the outer face member 30A and the outer surface of the back 22 flows downwardly on the base and onto the base or outer weather face member on the next lower row of panels.

From the foregoing it will be seen that the embossed structural roofing and siding system of the present invention provides a unique and pleasant appearance accurately resembling wood shakes or shingles, natural slate roofing tile or Spanish tile. The building provides panels that are light and strong for easy and rapid installation and each panel comprises both a structural element and an outer, weather resistant face element bonded into an integral unit. The building panels may be nailed, stapled or screwed in place rapidly on the upright structural members of a wall or roof structure and are readily installable even by unskilled persons. The interlocking joints are weatherproof and are structurally sound so that the building wall surfaces formed of the panels 20A, 20B or 20C of the present invention are not only neat in appearance, economical and structurally strong, but are also readily adapted for mass production prefabricating processes resulting in good savings in labor costs.

Although the present invention has been described with reference to several illustrative embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. An integral siding/roofing building wall panel, comprising:

an elongated rectangular base portion formed of structural sheet material having opposite spaced apart inner and outer faces, said base portion having longitudinal upper and lower edges dimensioned to span across for attachment with at least one pair of spaced apart upwardly extending parallel structural supports of a building structure, said lower edge of said base portion sloping upwardly at an acute angle from said inner face toward said outer face, said base portion including opposite ends adapted to lie along said structural supports and of sufficient thickness between said faces for providing a rigid wall, an outer surface portion formed of sheet material on the outer face of said base portion, said outer surface portion having an outer, weather resistant surface formed by an embossing process to resemble a plurality of shingle elements laid side by side and having an upper edge spaced downwardly and parallel of said upper edge of said base portion forming an exposed fastening strip surface on said outer face of said base portion along said upper edge, said outer surface portion terminating along said upper edge with an interlocking surface sloping upwardly and outwardly of said fastening strip surface of said base portion at an acute angle adapted for positive interlocking engagement with said sloped lower edge of said base portion of another of said building wall panels placed in an adjacent upward level against said structural supports, said outer surface portion having a lower edge portion projecting downwardly of said lower edge of said base portion and having an inner face portion adapted to abut and overlie said fastening strip surface on the base portion of another of said building wall panels interlocked therewith when placed in an adjacent lower level against said structural supports, said lower edge portion having an irregular lower edge formed to resemble lower edges of shingle elements placed side by side, and said outer surface portion formed with grooves between adjacent shingle elements open along said lower edge to discharge water onto the outer surface portion of a panel interlocked therewith in an adjacent lower row and a key spline along said upper edge of said outer surface portion, said key spline having a lower portion embedded in said base portion and sloping parallel of said interlocking upper edge of said outer surface portion.

2. The building wall panel of claim 1 wherein said base portion and said outer surface portion are formed of an integral piece of pre-formed multi-layer laminated sheet material having an upper layer embossed to form said shingle elements and said irregular lower edge.

3. The building wall panel of claim 1 wherein said outer surface portion is formed of molded plastic material laminated to said structural base portion.

4. The building wall panel of claim 3 wherein the outer surface of said outer surface portion is molded to resemble a plurality of "Spanish" tile shingles laid side by side in a row, each tile having an arched portion forming an open space between said tile and said base portion.

5. The building wall panel of claim 3 wherein said outer surface portion is formed to resemble a plurality of slate roofing tile shingles laid side by side in a row.

6. The building wall panel of claim 3 wherein said outer surface portion is formed to resemble wood shingles laid side by side in a row.

7. The building wall panel of claim 4 wherein one of said arched portions of said "Spanish" tile shingles is positioned adjacent one end of said base portion and another of said "Spanish" tile shingles is provided at the opposite end of said base portion, said other "Spanish" tile shingle including an outwardly projected edge portion adapted to project into said edge slot of a next adjacent building wall panel and overlie said outer face along an edge of said base portion thereof.

8. The building wall panel of claim 1 wherein said key spline is formed with at least one opening therein for drainage of moisture from an upper side thereof onto the outer surface of said outer surface portion.

* * * * *